US006244480B1

(12) United States Patent
Sepulveda et al.

(10) Patent No.: US 6,244,480 B1
(45) Date of Patent: Jun. 12, 2001

(54) CHILDREN'S MIRRORED VALET

(76) Inventors: Alfredo R. Sepulveda; Audrey M. Sepulveda, both of 15834 Warm Springs Dr., Canyon Country, CA (US) 91351

( * ) Notice: Subject to any disclaimer, the term of this patent is extended or adjusted under 35 U.S.C. 154(b) by 0 days.

(21) Appl. No.: 09/548,843

(22) Filed: Apr. 13, 2000

(51) Int. Cl.[7] ..... A41M 5/00
(52) U.S. Cl. ..... 223/120
(58) Field of Search ..... 223/120, 66, 68, 223/111; 248/467, 469, 470, 471

(56) References Cited

U.S. PATENT DOCUMENTS 3,010,225 * 11/1961 Hale ..... 223/66
4,739,911 * 4/1988 Quinn ..... 223/85
5,727,717 * 3/1998 Vigne ..... 223/66
5,971,555 * 10/1999 Wilcox et al. ..... 359/872

* cited by examiner

*Primary Examiner*—Bibhu Mohanty

(57) ABSTRACT

A figurine including a backboard is shaped in the form of an individual and constitutes a figurine having a torso central portion with arm and leg extremities outwardly projecting therefrom as well as a head including face and hair simulations. The garment figurine provides a central opening in the torso portion of the backboard which supports a mirror usable when clothes are not put on the figurine. A plurality of attachment tabs or points are provided about the central opening occupied by the mirror which constitute fastening locations whereby selected garments may be temporarily placed against the front of the backboard and held in position by such fasteners as magnets, clips or the like. Preferably, such attachment points would reside at the top of the mirror and at the sides of the mirror which represent the shoulders and waist of the figurine. Attachment devices may be employed on the back of the backboard for hanging the figurine on a wall surface.

13 Claims, 2 Drawing Sheets

FIG. 1
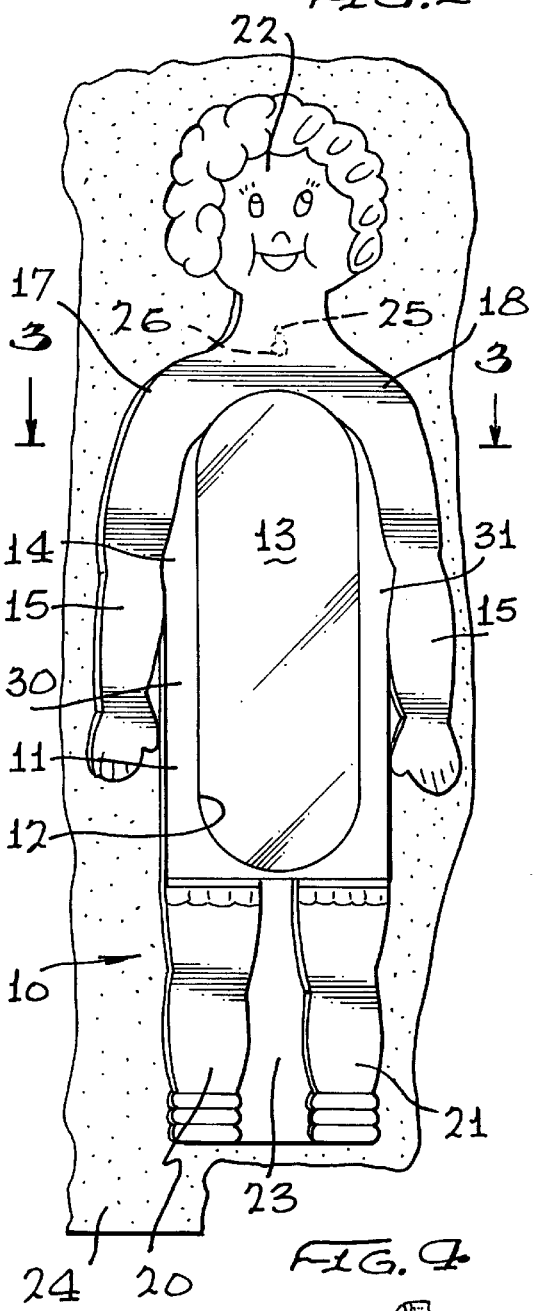
FIG. 2
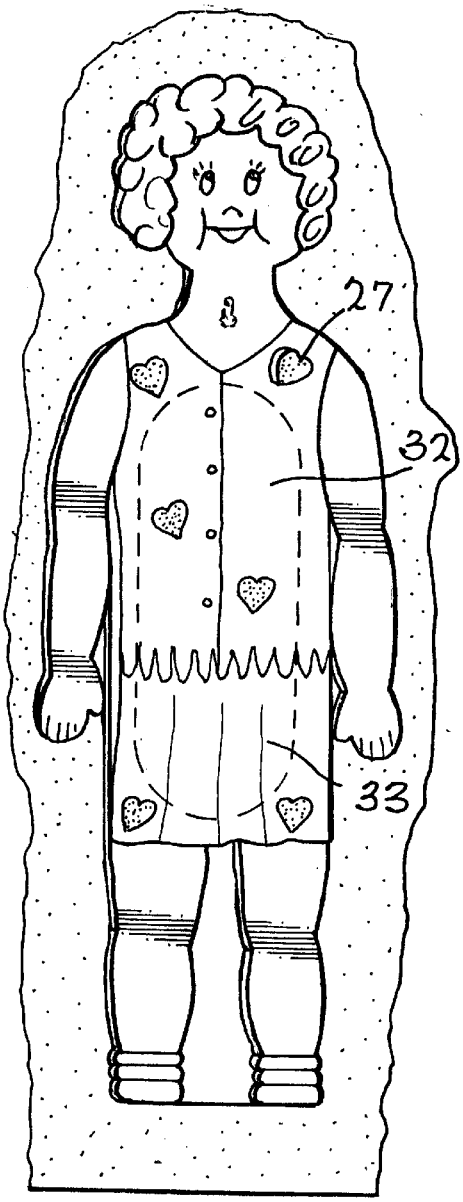
FIG. 4
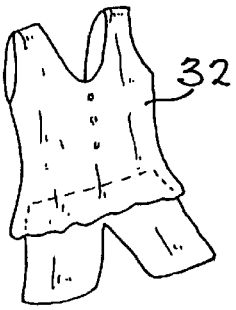
FIG. 5
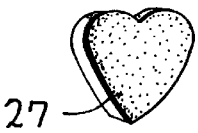
FIG. 3
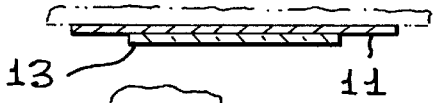
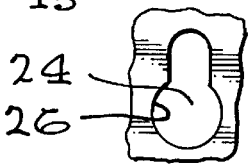
FIG. 6

FIG. 7
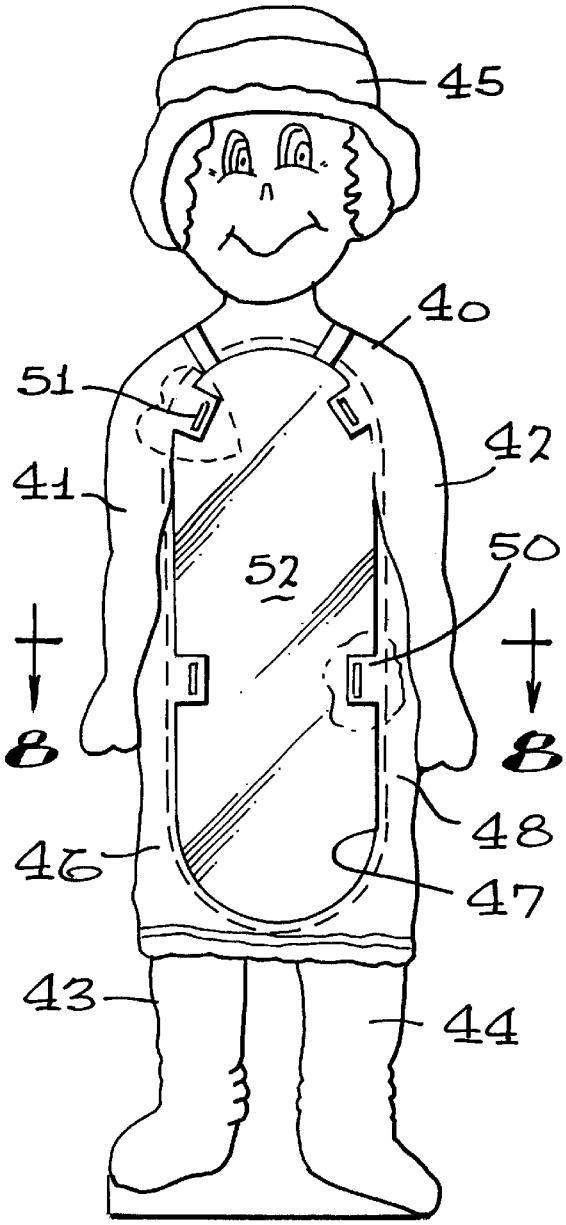
FIG. 10
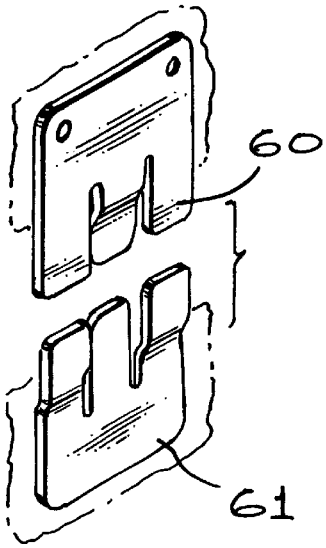
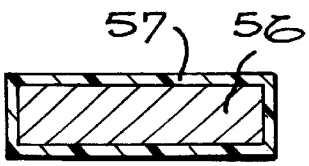
FIG. 9
FIG. 8
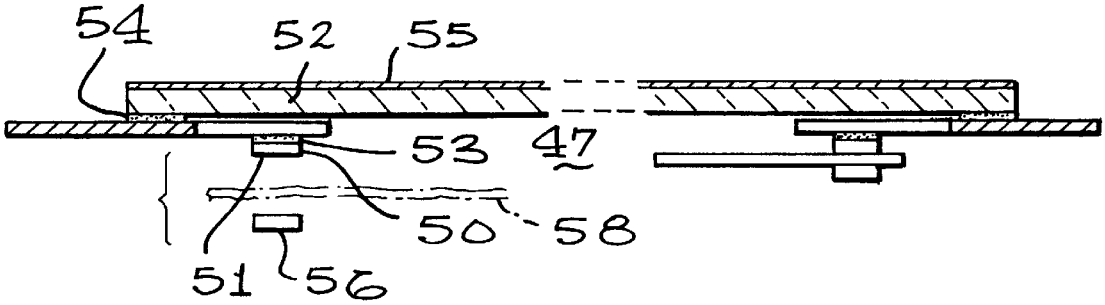

CHILDREN'S MIRRORED VALET

BACKGROUND OF THE INVENTION

1. Field of the Invention

The present invention relates to the field of mannequins, garment caddies or valets, and more particularly to a novel figurine for supporting a variety of garments allowing the user to make personalized selection of garments in a coordinated, educational and fashionable manner.

2. Brief Description of the Prior Art

In the past, it has been the conventional practice for persons to select a wardrobe by removing clothes from a closet, cabinet or the like and placing the garments in some form of coordinated position on the bed, chair or even the floor. In other instances, people may select certain garments and progress through the closet by holding the garment against other garments to check style, color and fashion coordination. The coordination of clothes is a learned skill and it is difficult for children to coordinate their wardrobes without some motivation and assistance from parents.

Some attempts have been made to provide a hanging arrangement for children's clothes which usually provides for a backboard having a plurality of pegs or hooks outwardly projecting from the backboard on which clothes are supported. Such a device for assisting a child in selecting wardrobe is ineffective since the clothes are not arranged in a simulated form as would be normally worn. Also, the hanging of clothes on hooks or pegs has a tendency to distort the shape of the garments and in some instances, may even cause damage.

Therefore, a long-standing need has existed to provide a novel means for supporting a plurality of garments in a fashionable way so that children can readily coordinate their own personalized wardrobe. Such a means must also include structure which motivates the child to use the device for wardrobe coordination.

SUMMARY OF THE INVENTION

Accordingly, the above problems and difficulties are avoided by the present invention which provides a novel figurine that may be self-supporting or may be hung on the wall and wherein a backboard is shaped in the form of an individual of any particular gender, animal or comic character. The shape of the backboard constitutes a figurine having a torso central portion with arm and leg extremities outwardly projecting therefrom as well as a head including face and hair simulations. The hair is formed in hardwood cutout fashion or soft yarn of different colors. A feature of the garment figurine resides in providing a central opening in the torso portion of the backboard which supports a mirror usable when clothes are not put on the figurine shaped backboard. A plurality of attachment tabs or points are provided about the central opening occupied by the mirror which constitute fastening locations whereby selected garments may be temporarily placed against the backboard and held in position by such means as magnets, clips or the like. Preferably, such attachment points would reside at the top of the mirror and at the sides of the mirror which represent the shoulders and waist of the figurine. Attachment means may be employed on the back of the backboard for hanging the backboard on a wall surface.

Therefore, it is among the primary objects of the present invention to provide a baseboard or backboard member shaped as a figurine on which selected garments may be removably attached so that the user of the device may personalize selection of a daily wardrobe.

Another object of the present invention is to provide a novel garment figurine for removably supporting various items of clothing so that the user can visually observe color, style and-texture for wardrobe selection.

Yet another object resides in providing a garment figurine having the means for detachably supporting a variety of garments on the front face thereof and it would further include a central mirror for use when the garments have been removed.

Still a further object resides in providing a garment figurine or caddy for holding various articles of clothing for wardrobe selection and which includes motivating designs and shapes so that the device is educational as well as playful.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the novel garment figurine incorporating the present invention illustrated with garments detached;

FIG. 2 is a view similar to the view of FIG. 1 illustrating the garment figurine clothed as would be used in personal garment selection;

FIG. 3 is a reduced transverse cross-sectional view of the garment figurine shown in FIG. 1 as taken in the direction of arrows 3—3 thereof;

FIG. 4 is a reduced perspective view of a typical garment that may be placed on the garment figurine as shown in FIG. 2;

FIG. 5 is a perspective view of a typical magnet which may be employed to releasably secure clothing or garments onto the location points on the garment figurine as shown in FIG. 2;

FIG. 6 is an enlarged fragmentary view illustrating a hook aperture formed in the garment figurine so that the figurine may be held on a wall surface;

FIG. 7 is a front elevational view of another embodiment of the invention;

FIG. 8 is an enlarged transverse cross-sectional view of the figurine shown in FIG. 7 as taken in the direction of arrows 8—8 thereof;

FIG. 9 is a transverse cross-sectional view of a plastic covered magnetic used in the figurine assembly; and FIG. 10 is a perspective view of an alternative hanger used to removably support the figurine from a wall surface.

DESCRIPTION OF PREFERRED EMBODIMENT

Referring to FIG. 1, the novel garment figurine of the present invention is illustrated in the general direction of arrow 10 and includes a baseboard or backboard 11 having a central opening 12 which is occupied by a mirror 13. The backboard 11 is shaped about its periphery to represent a figure having a torso, broadly represented by numeral 14, and arms 15 and 16 joined together at shoulder areas 17 and 18 on opposite sides of the torso. The baseboard also includes legs 20 and 21 so that the figure truly represents the outline of a person, animal or comic character. The outline or shape of the backboard may be that of a boy, girl, man or the like. To complete the human form, a head 22 is provided integrally formed with the shoulder areas 17 and 18 and a face may be carried on the exposed surface of the head 22 as well as the display of either hard or soft hair.

The mirror 13 may be affixed to the backboard by any suitable means such as molding, clips or the like. The outline or shape of the figure can be complete about the peripheral edge or may be partially about the peripheral edge and painted with the remainder of the figure on the front surface of the backboard. For example, legs 20 and 21 may be cut out of the backboard to represent legs or, as illustrated, the legs may be painted on the surface of the baseboard so that a central part of the baseboard, as indicated by numeral 23, will be exposed.

The baseboard 11 may be suitably mounted on a wall surface 24 by means-of a hook or pin fastener 25 projecting into an aperture or hole in the baseboard, such as represented by numeral 26.

With regard to FIG. 2, the figurine 10 has been placed on the wall surface 24 and the exposed surface of the baseboard substantially covering the mirror 13, there is provided clothing or garments which are temporarily fastened to the surface of the baseboard. Such garments have been placed in position on the figurine by the user in order to judge color, fashion style and other wardrobe considerations. The garments are held in the temporary position on the baseboard or backboard 11 by means of magnetic fasteners, such as a magnetic heart-shaped fastener for example. In order for the fastener 27 to releasably hold the garment in position, another magnetic or contact component is fastened to certain select locations on the front of the baseboard. Such select locations include the shoulder areas 17 and 18 as well as waist areas 30 and 31, as seen in FIG. 1. A garment for the upper torso is represented by numeral 32 while the lower garment, such as a skirt 33, is supported from the waist of the figurine. In lieu of magnetic fasteners, it is to be understood that other fasteners, such as U-shaped clips, may be placed over the shoulder edges at areas 17 and 18, which would hold the upper garment 32 in position while similar clips can be used at the waist edges 30 and 31 to hold the lower garment 33 in position. Upon inspection, the user may decide to wear the combination arranged on the figurine or if not suitable, the user may replace the garments with additional selections from the closet wardrobe. Once the garments have been selected and worn by the user, the user can inspect the wardrobe by looking into the mirror 13. By hanging the baseboard 11 from the pin 25 in an elevated position, the height of the mirror can be properly located so that the user may readily view herself.

In FIG. 3, it can be seen that the mirror 13 can be joined to the backboard or baseboard 11 by an adhesive or by a separate molding which mounts the mirror thereon. In FIG. 5, a suitable magnetic fastener 27 is illustrated which is composed of a magnetic material and serves as one component of a magnetic fastener. The other component of the fastener if fixedly attached to the selected locations on the baseboard, such as the shoulders 17 and 18 and the waist areas 30 and 31. Additional fasteners can be placed at the choice of the user.

FIG. 4 shows the garment 32 which may be removably placed on the figurine at the selection of the user.

FIG. 6, an enlarged view of the opening 26 is shown whereby the baseboard 11 may be hung from a suitable pin 25.

Referring to FIGS. 7–9 inclusive, another embodiment of the invention is illustrated wherein a backboard or base 40 is shaped as a predetermined figurine and as an example, the shape is of a person having extremities such as arms 41 and 42, legs 43 and 44, a head 45 and a torso 46. The backboard 40 includes a central opening or cut-out 47 which includes an edge marginal region 48 from which a plurality of tabs, such as tab 50, projects into the central opening 47. The tabs are integrally provided with the backboard and have a front and a rear surface. The front surface is even and coextensive with the front surface of the backboard. The front surface of the backboard carries indicia and/or graphic representations of a particular figurine. The front surface of each tab carries a ceramic magnet 51 glued or otherwise adhered to the tab.

Immediately behind or occupying the central opening there is an elongated mirror 52 that is edge mounted to the backboard by any securement means such as a double sided adhesive tape, glue, adhesive or the like. The backboard may be freestanding or wall mounted.

Referring to FIG. 8, the adhesive 53 secures the magnetic 51 to the tab 50. Adhesive 54 secures the edge marginal region of the mirror 52 to the back of edge marginal region 48 of the backboard and to the rear surface of the tabs. A multiplicity of strips 55 are placed across the back surface of the mirror so as to prevent shattering of glass should the mirror break. FIG. 8 further illustrates a loose or separate magnet 56 which is a magnetically coated plastic 57 as illustrated in FIG. 9. A garment 58 is arranged on the backboard front surface so that the mirror is covered and the extremities exposed. When suitably arranged, the loose or separate magnets 56 are placed on the outer part of the garment at each tab location. The magnetic attraction of the two magnets at each location releasably secures the garment to the backboard.

FIG. 9 shows a hook assembly for wall mounting of the figurine. Component 60 may be attached to the back of the backboard and component 61 may be secured to a flat wall surface.

In view of the foregoing, it can be seen that the garment figurine of the present invention presents an attractive representation of a figure on which a variety of clothes may be removably placed so that the user can choose a suitable and coordinated wardrobe. The fasteners for releasably holding the garments in place can take the form of magnetic clips of most any shape and size or may take the shape and form of clips that releasably hold the garments to the edge of the baseboard. Additional attractive accessories can be placed on the figure, such as painting of socks or the like, on the legs of the figurine and headgear such as baseball caps can be added to the head 22 of the figurine. The employment of the mirror 13 augments the figurine since the user can review himself or herself with the selected garments being worn.

In the employment of the garment figurine of the present invention, a child can be taught to coordinate wardrobe in a fun, educational and creative way so that the proper selection, coordination of colors and organization of outfits can be arranged for the entire day. Parents are relieved of stress and frustration of having to coax a child to try on various garments over and over. Individually painted facial expressions or the like may be placed on the head area 22 and space efficiency is assured since the garment figurine can be hung on any wall or door surface. The cheerful and colorful presentation of the garment figurine incorporates the full length inset mirror 13 and the fasteners may be magnets which allow the child to easily hang selected garments on the baseboard selecting what the child would like to wear, such as shirts, skirts, pants, shorts, etc. Psychological advantages are presented by allowing the child to gain confidence in choosing an outfit which is coordinated by selecting colors on his own while having fun and entertainment. The mirror 13 permits the dressed children to view themselves in the same outfit as the figurine. Therefore, the use of the garment figurine assists the child in choosing an outfit which represents fund and an educational experience.

Other variations and embodiments of the invention are envisioned such as a figurine form including a padded surface of foam, poly foam, or cotton fill covered in fabric, vinyl, plastic, fleece, imitation fur, leather, or other assorted application not listed. This outer surface will cover the foam creating a softer surface with various textures and top stitching, buttons or other fasteners and appliques. In some designs there may be paint added to the surfaces for detailing of the design.

The invention may also include a cork center in addition to the mirrored center. Cork, pin board, or dry pen surface may be used in some designs in the center area. This allows variation of the invention to include its use as a mirror, writing surface (chalk board, wipe off marker surfaces), and pin up board used cork or cork like materials.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A garment figurine comprising:

an elongated backboard having a central section provided with a major opening;

a plurality of extremities outwardly projecting from said backboard so that said backboard and said extremities constitute a recognizable shape of a specific figure;

a mirror mounted on said backboard having a mirrored surface exposed through said major opening; and a two-component attachment means cooperatively disposed on said backboard immediately adjacent to central opening for releasably securing a garment to said backboard.

2. The garment figurine as defined in claim 1 wherein:

said two-component attachment means includes a first component fixed to said backboard and a second component deployable to hold the garment on said backboard in combination with said first component.

3. The garment figurine as defined in claim 2 wherein:

said two-component attachment means includes at least four sets of said first and said second components.

4. The garment figurine as defined in claim 3 wherein:

said backboard includes at least four tabs integrally provided about said central opening in a fixed, spaced-apart relationship and said tabs projecting into said central opening; and said first component of each set of said two-component attachment means secured to each of said tabs.

5. The garment figurine as defined in claim 4 wherein:

said two-component attachment means are composed of magnetic materials employing magnetic attraction forces to retain the garment between said first component and said second component of each of said sets.

6. The garment figurine as defined in claim 5 wherein:

said backboard has a front display surface and a back surface;

said mirror having an edge marginal region fixed to said backboard about said central opening; and said front display surface carrying a graphic representation.

7. The garment figurine as defined in claim 6 wherein:

said graphic display is a facsimile of a person including indicia depicting a head, arms, legs and a torso.

8. The garment figurine as defined in claim 7 wherein:

said torso graphic representation carried on said front display surface about said central opening.

9. The figurine for removably supporting a garment comprising:

an elongated backboard having a central opening defined by an edge marginal region;

a mirror having a peripheral edge fixed to said edge marginal region and having a mirrored surface exposed through said central opening;

said backboard having a front display surface carrying a graphic representation including a torso display about said central opening;

a plurality of tabs integrally provided on said backboard projecting into said central opening from said edge marginal region and partially over said mirrored surface;

a first magnetic component fixed to each of said tabs; and a second magnetic component loose from said backboard and said first magnetic component and adapted to cooperate with said first magnetic component to support a portion of a garment there between.

10. The figurine as defined in claim 9 including:

said backboard having a backside for fixing and supporting said mirror on said edge marginal region; and said mirror having an unmirrored back surface provided with a plurality of strips in fixed, spaced-apart relationship providing reinforcement to said mirror.

11. The figurine as defined in claim 10 including:

hook means carried on said backboard for supporting said backboard from a wall surface.

12. The figurine as defined in claim 10 wherein:

said backboard includes a stand for maintaining said backboard in a self-supporting standing position.

13. The figurine as defined in claim 10 wherein:

said central opening is elongated having a top end, a bottom end and a pair of sides integrally joining said top end with said bottom end; and said plurality of tabs critically located with an upper pair of tabs adjacent said top end and a lower pair of tabs midway between said top end and said bottom end.

* * * * *